US005528251A

United States Patent [19]

Frein

[11] Patent Number: 5,528,251

[45] Date of Patent: Jun. 18, 1996

[54] DOUBLE TUNED DIPOLE ANTENNA

[76] Inventor: Harry S. Frein, 24 Orchard View Ct., Belleville, Ill. 62221

[21] Appl. No.: 417,838

[22] Filed: Apr. 6, 1995

[51] Int. Cl.[6] ..... H01Q 9/00

[52] U.S. Cl. ..... 343/749; 343/802; 343/810; 343/822; 343/901

[58] Field of Search ..... 343/722, 735, 343/740, 749, 751, 752, 736, 793, 794, 802, 803, 804, 805, 809, 810, 822, 831

[56] References Cited

U.S. PATENT DOCUMENTS

| | | | |
|---|---|---|---|
| 2,229,078 | 1/1941 | Hansell | 343/809 |
| 2,619,596 | 11/1952 | Kolster | 343/794 |
| 2,834,015 | 5/1958 | Carpenter | 343/808 |
| 2,898,590 | 8/1959 | Pichitino | 343/722 |
| 2,937,374 | 5/1960 | Cork | 343/808 |
| 3,513,473 | 5/1970 | Seward | 343/752 |
| 3,660,848 | 5/1972 | Kerch | 343/749 |
| 3,928,854 | 12/1975 | Tacussel | 343/735 |

*Primary Examiner*—Donald T. Hajec
*Assistant Examiner*—Tan Ho
*Attorney, Agent, or Firm*—Don W. Weber

[57] ABSTRACT

A double dipole tuned antenna is presented having the capability to enhance the television reception, particularly on VHF frequencies. The antenna has an outer, longer diverging dipole antenna connected near its midsection to an inner, shorter, parallel diverging dipole. Also connected to the inner dipole is a large helical coil and a smaller helical coil. A capacitor is placed in parallel across opposite ends of the smaller helical coil in order to tune the device. The device is particularly useful for tuning VHF frequencies although it is also useful in tuning UHF frequencies.

7 Claims, 1 Drawing Sheet

DOUBLE TUNED DIPOLE ANTENNA

BACKGROUND OF THE INVENTION

This invention relates to the field of reception of electrical signals. More particularly, this invention relates to a unique double dipole antenna having electrical components that provide very good reception of television signals, particularly for the lower VHF channels.

With the onset of electronic communication, the development of antennas became of paramount importance. The antenna is used to receive the electromagnetic radio waves that are broadcast and are to be received by the radio, television or other electronic receiver. Antennas come in varying sizes, shapes and electrical configurations.

One of the earliest and most common types of antenna is known commonly as the "rabbit ears" antenna. This type of antenna, used for television reception, has a lower central base and two diverging linear electronic components. The length of the diverging ears, as well as the angle of divergence and the rotational position of the antenna has been the subject of modification and improvement. The simplest rabbit ears dipole antenna consists of the linear diverging parts connected at the base and fed to the television through a 300 ohm cable. Other, more complicated, versions of the simple rabbit ears antennas have been developed. One in particular uses a circular dial connected to various electronic components at the base of the diverging ears. Turning the dial tunes the antenna so that particular frequencies may be received.

Typically, there is a difference in the tuning necessary to tune lower VHF signals (channels 2 through 6) as opposed to tuning higher VHF frequencies (channels 7 through 13). In addition to tuning the VHF signals, it is common for the antenna to also tune the upper UHF signals, commonly channels 14 through 60.

A number of different types of antenna have been used to improve television reception. One V-type directional antenna, shown and described in U.S. Pat. No. 3,928,854 issued in 1975 to Tacussel, discloses a unique variation of the typical single dipole antenna. Tacussel describes the use of two, parallel diverging dipoles connected along their midsections by resistors. Tacussel states that his antenna is highly directional forming a narrow beam in a first plane and a wide beam in a second plane perpendicular to the first plane. Tacussel describes various aspects of an antenna system including the direction of the radiators with respect to the wavelengths to be received.

While the Tacussel antenna was an innovative advancement in this field in the 1970s, more sophisticated antenna, such as the one presented here, show marked improvement for reception of the average television receiver. Although antennas which may be tuned by dials were an improvement in the antenna art, with the onset of remote control, by which the viewer can change the television channels without getting up and approaching the television, the need has arisen for a dipole antenna which effectively tunes the various VHF channels without the necessity for approaching the antenna and turning various knobs to obtain good reception.

It is an object of this invention to provide an antenna effective for receiving VHF and UHF television signals which does not need to be separately tuned when the station on the television is changed.

Another object of this invention is to provide a double dipole antenna having an upper large helical coil and lower electronic components tuned to enhance television reception, particularly for channels of a VHF band broadcast.

Often, the standard rabbit ears type of antenna do not perform well at the fringes of reception for most television stations. It is another object of this invention to provide a double dipole antennae which is capable of receiving a clear signal from VHF television stations even at the fringe area of the broadcast range. It is a still further object of this invention to provide a powerful double dipole antenna for receiving television stations which does not require individual tuning for separate stations.

Other and further objects of this invention will become apparent upon reading the following Specification.

BRIEF DESCRIPTION OF THE DEVICE

A double dipole tuned rabbit ear television antenna is presented. The first dipole consists of telescoping diverging linear elements approximately 50 inches long each. A second, smaller, parallel inner dipole antenna is electrically connected to the first dipole. This inner, shorter parallel dipole is connected to the outer longer dipole antenna. Also electrically connected to the double dipoles is a large, double helical coil. Opposite ends of this large coil are connected electrically to the left and right bases of the inner smaller dipole elements. Beneath the dipoles and large helical coil 6 are a small helical coil, with opposite ends of the small coil connected to the lower base of the left and right lower, smaller dipole elements respectively. Connected across the opposite ends of the smaller helical coil is a capacitor.

Without the necessity for any further tuning, the double dipole antenna with the large helical coil, small helical coil and capacitor, is capable of receiving excellent reception, particularly on VHF channels at even the fringe areas of broadcast receptions.

DETAILED DESCRIPTION OF THE PREFERRED EMBODIMENT

Figure 1:
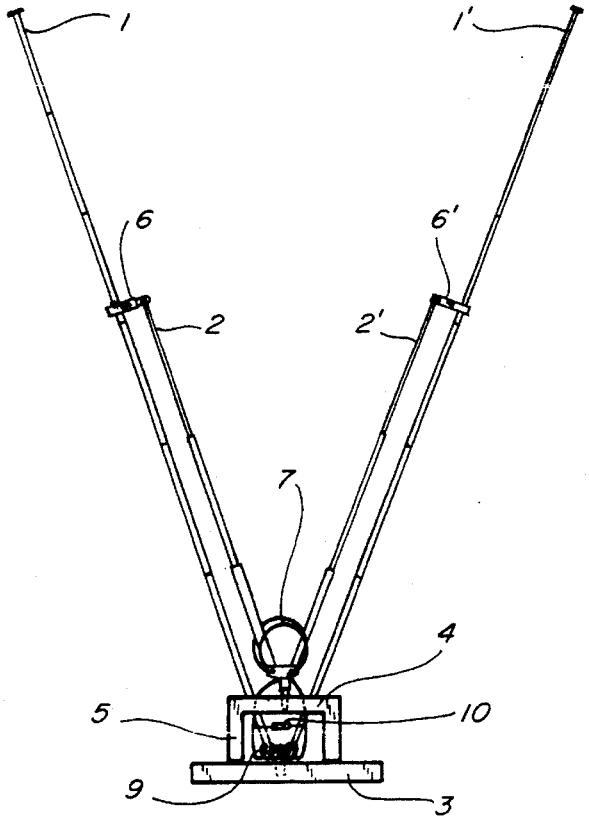
FIG. 1 is a front view of the double-tuned dipole antenna.

A double-tuned dipole antenna is presented. The antenna comprises long and short parallel dipole antennas connected to a number of tuning components. As best shown in FIG. 1, an outer, long, dipole antenna is connected to the other electronic circuitry. The left element 1 and right element 1' of the outer, long first dipole antenna is connected to the left 2 and right 2' element of the inner, shorter dipole antenna as shown. In the preferred embodiment, the left inner and outer and right inner and outer dipole elements are connected by means of a connector 6 (for the left side) and right 6' (for the right elements). These detachable connectors may be of any convenient type, battery clips being the preferred method of connection.

The dipole antenna elements are all of a telescoping nature, a feature well known in the art. The outer, longer dipole elements are preferably 51" in length when fully extended. The inner, shorter dipole elements 2 and 2' are approximately 27" when fully extended. The distance between the inner and outer parallel dipole elements is approximately 2". Both the inner and outer dipole elements are parallel to each other but diverge from their base, as shown in FIG. 1. While the dimensions given herein are preferred, it is to be noted that they are meant as means of illustration only and not as a limitation. In fact, these dimensions may vary at least plus or minus 10% and still be within the scope of this invention.

The outer dipole antenna is physically mounted to a lower base 3, which may be of wood or other non-conducting material. The lower base has sides 5 which support an upper base 4. The upper base 4 supports the inner, shorter dipole antenna elements 2 and 2' as shown on FIG. 1. The distance between the base of the lower and upper dipoles is approximately 4½ inches. While this base has been found to be a convenient means for supporting the electrical structure, it is meant as a means of illustration only and not as a limitation. A hollow plastic base and upper portion can support both parallel dipoles as well as many other configurations.

Figure 2:
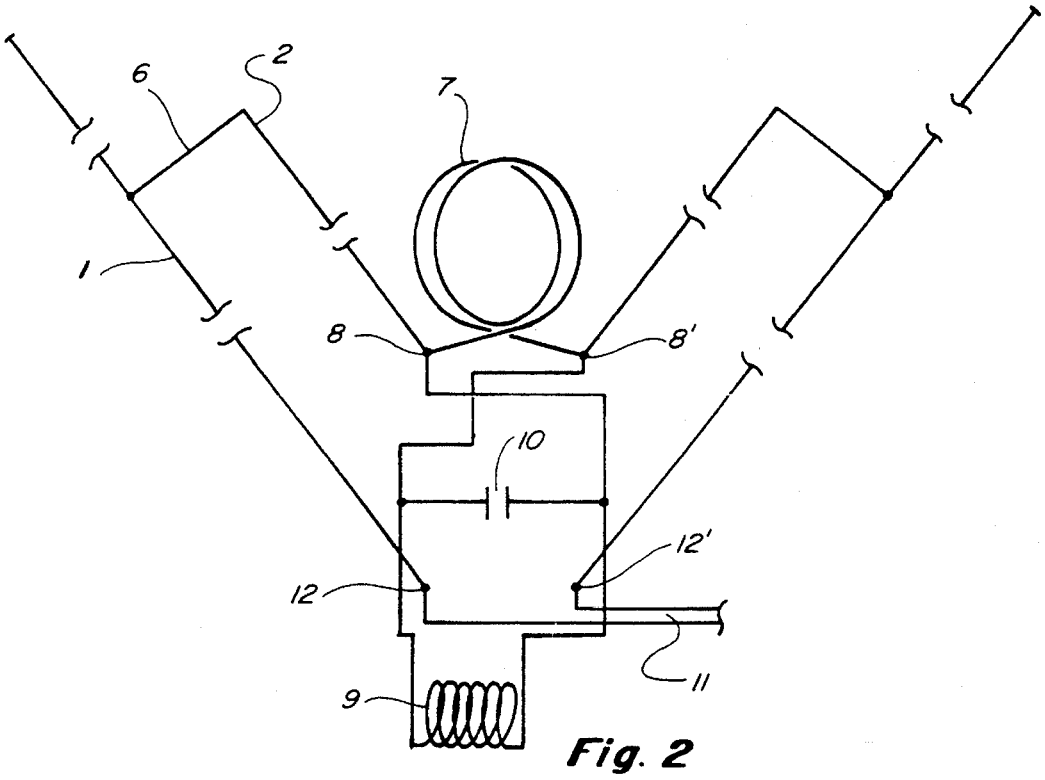
FIG. 2 is a schematic representation of the double-tuned dipole antenna showing the various component parts and electrical connections.

As best shown on FIG. 2, a large helical coil 7 also forms part of the electronic apparatus of this device. The preferred helical coil is double looped, having a leftwardly projecting end of the helical coil connected to the lower portion or base of the inner left shorter dipole element at point 8. The rightwardly projecting end of the large helical coil 7 is connected at the lower portion or base of the right shorter dipole element at point 8', as shown on FIG. 2.

Located physically beneath the inner dipole and large helical coil in the preferred embodiment are two other electrical components used for tuning the circuit. As shown physically on FIG. 1, a smaller helical coil 9 and a capacitor 10 are connected to the other electrical components of the device.

As best shown on FIG. 2, the leftwardly projecting end of the small helical coil 9 is connected to the right inner, smaller dipole element at its base 8'. The rightwardly projecting end of the small helical coil 9 is electrically connected to the left smaller inner dipole elements at its base 8.

Connected across the left and right ends of the small helical coil 9 is a capacitor 10 as shown in FIG. 2. The 300 ohm antenna leads 11 are connected to the device at the lower base 12 of the left outer long dipole element 1 and at the lower base 12' of the right outer longer dipole element 1'. This 300 ohm antenna lead 11 connects the antenna device to the television set for reception.

It has been found that the most convenient connector 6 and 6' for the inner and outer dipole elements is some sort of detachable clip. Making the inner and outer dipole elements detachable better facilitates the reduction of the length of the antenna by telescoping the antenna ends into a smaller and more compact area.

The large helical coil 7 is preferably made from number 10 gauge insulated electrical wire. This larger coil 7 has a circular conductive impedance. The large helical coil 7 tends to tune the higher frequencies of the VHF television band, normally channels 7 through 13. While a single loop may be used for the large coil 7, the preferred embodiment has a double helical loop. However, different sizes, gauges and numbers of loops are still within the scope and spirit of the present device, the double loop being preferred. Each loop of the double loop embodiment has an approximate diameter of 4". The total length of the double loop would be approximately 19½ inches.

The lower, smaller coil 9 is also made of number 10 gauge electrically insulated wire in the preferred embodiment. This smaller coil 9 has smaller loops with each having an approximate diameter of 1". In addition, the preferred number of turns or loops in the smaller coil 9 is five or six. This smaller coil 9, helps to tune the lower VHF channels (channels 2 through 6). However, the lower smaller coil does not interfere with the receptive qualities of the device in regard to the higher VHF channels 7 through 13. It has been found that the larger upper and smaller lower coils work in harmony to achieve good reception for all VHF channels.

An added improvement to this particular device is the capacitor 10 which is electrically connected in parallel between the opposite sides of the smaller coil 9 as shown on FIG. 2. It has been found that the actual rating of the capacitor used in this device is not critical. However, capacitors with a capacitance of between 0.005 and 0.01 microfarads is preferred though not critical. When six turns are utilized in the small helical coil 9, it has been found that spacing the coils approximately one-fourth inch apart from each other enhances the performance of the instant device.

In use it has been found that the preferred angle of divergence of the parallel inner and outer dipoles is approximately 80 degrees. However, since directions and distances from the television broadcasting station may vary, this angle may also vary depending on the circumstances and location of the device in use.

In the operation of this device, it is to be noted that the longer, outer dipole actually picks up the signal while the inner, shorter dipole antenna elements are present as a tuning mechanism. The large and small coils, as well as the capacitor, are also designed to increase reception of the television, particularly for the VHF channels.

While the reception of this device is most notably improved with respect to VHF channels, the device is also useful in receiving UHF channels.

While the antenna can be used in a vertical or horizontal position, the preferred use is at a diverging angle of 80 degrees and an orientation such that the best picture may be obtained. As shown on FIG. 1, the length of the extended inner dipole is approximately 27". Because the outer longer dipole, is connected to the lower base 3 rather than the upper base 4, the distance between the lower base portion of the outer element and the connector 6 is approximately 30". The remaining length of the extended outer dipole is approximately 21" giving the outer dipole elements a total extended length of approximately 51". These dimensions are for purposes of illustration only. Other lengths may be utilized while still keeping within the spirit of this device.

This invention utilizes two parallel dipoles electrically connected near the midlength of the outer dipole. Because the coils and capacitor are fixed, the antenna itself is tuned. The configuration of the elements as shown and described allows the antenna to remain tuned for good VHF reception. Due to the fixed nature of the electrical components, separate tuning of the antenna for separate VHF channels is not required.

Having fully described my invention, I claim:

1. A double tuned dipole antenna, comprising:

(a) left and right long diverging dipole elements electrically connected parallel to left and right short diverging dipole elements;

(b) a large helical coil having at least one turn and having one end electrically connected to the base of said left short dipole element and having the other end electrically connected to the base of said right short dipole element;

(c) a small helical coil having a right end electrically connected to the base of said left short dipole element and having a left end electrically connected to the base of said right short dipole element; and (d) a capacitor electrically connected in parallel across the opposite ends of said small coil.

2. A double tuned dipole as in claim 1, wherein said large helical coil has two turns, each turn having a diameter of approximately four inches.

3. A double tuned dipole as in claim 2, wherein said large helical coil is made of #10 gauge insulated electrical wire.

4. A double tuned dipole as in claim 1, wherein said small helical coil has at least five turns, each turn having a diameter of approximately one inch, each turn separated by approximately one-fourth inch.

5. A double tuned dipole as in claim 2, wherein said small helical coil is made of #10 gauge electrical wire.

6. A double tuned dipole as in claim 1, wherein said capacitor has a capacitance of between 0.005 and 0.01 Mfd.

7. A double tuned dipole antenna, comprising:

(a) left and right telescoping, long, diverging dipole elements, each having approximately 51 inches in extended length, electrically connected parallel to left and right telescoping, short diverging dipole elements, each having approximately 27 inches in extended length, (b) a large double helical coil having a diameter of approximately four inches, having one end electrically connected to the base of said left short element and having the other end electrically connected to the base of said right short element;

(c) a small helical coil having a plurality of turns, each turn being approximately one-fourth inch in diameter, having a right end electrically connected to the base of said left short dipole element and having a left end electrically connected to the base of said right short dipole element; and (d) a capacitor having a capacitance of between 0.005 and 0.01 Mfd. connected in parallel across the opposite ends of said small coil.

* * * * *